US005855039A

United States Patent [19]

Crawford

[11] Patent Number: 5,855,039

[45] Date of Patent: Jan. 5, 1999

[54] DELAY DOOR CLOSER

[76] Inventor: Alan D. Crawford, 2615 W. Victory-Unit B, Burbank, Calif. 91505

[21] Appl. No.: 815,954

[22] Filed: Mar. 13, 1997

[51] Int. Cl.[6] ..... E05F 1/00

[52] U.S. Cl. ..... 16/49; 16/DIG. 17; 16/71; 49/137; 49/379

[58] Field of Search ..... 16/71, 66, 70, 16/80, 82, 84, 72, DIG. 17, 49; 49/137, 322, 379

[56] References Cited

U.S. PATENT DOCUMENTS

| | | | |
|---|---|---|---|
| 4,194,264 | 3/1980 | Stoffregen | 16/52 |
| 4,506,407 | 3/1985 | Downey | 16/48.5 |
| 4,536,916 | 8/1985 | Storandt et al. | 16/48.5 |
| 4,803,754 | 2/1989 | Roberts | 16/49 |
| 4,815,163 | 3/1989 | Simmons | 16/49 |
| 4,878,265 | 11/1989 | Nesbitt | 16/49 |
| 4,894,883 | 1/1990 | Fleischhauer | 16/66 |
| 5,048,150 | 9/1991 | Guerin | 16/49 |
| 5,083,342 | 1/1992 | Klinefelter | 16/70 |
| 5,131,115 | 7/1992 | Sarto | 16/82 |
| 5,293,666 | 3/1994 | Armstrong | 16/84 |
| 5,311,642 | 5/1994 | Tillman et al. | 16/65 |
| 5,592,780 | 1/1997 | Checkovich | 49/386 |
| 5,630,248 | 5/1997 | Luca | 16/71 |

*Primary Examiner*—Chuck Y. Mah
*Assistant Examiner*—Donald M. Gurley
*Attorney, Agent, or Firm*—Jack C. Munro

[57] ABSTRACT

The subject invention is a delay door closer that is to be used in conjunction with a dual door arrangement such as a screen door mounted in conjunction with an entry door of a house or other building. A catch mechanism is mounted on the door jamb with the catch mechanism functioning to lock and hold the screen door in an open position when the entry door is in the closed position. Upon opening of the entry door a sufficient amount to where the user is now able to enter the building, the catch mechanism is disengaged which will cause the screen door to be moved from its open position to a closed position.

10 Claims, 4 Drawing Sheets

DELAY DOOR CLOSER

BACKGROUND OF THE INVENTION

1. Field of the Invention

The field of this invention relates to door closers and more particularly to a door closer that works in conjunction with an entry door and its associated screen door to make the closing action of the screen door dependent upon the opening position of the entry door.

2. Description of the Prior Art

Dual door arrangements consisting of an entry door, a screen door and a screen door closer are common on houses and apartment buildings. When one wishes to enter a house or building with such a dual door arrangement, the user opens the screen door and then must hold it open while unlocking the entry door. This can be particularly annoying when carrying packages. With no hands available, the screen door now presses against the individual or the individual's packages while at the same time the individual is fumbling with the lock of the entry door.

The biasing mechanism of the screen door from its open position to the closed position typically constitutes a pneumatic damper arrangement. Incorporated in conjunction with this pneumatic damper arrangement is a small metal tab which can be positioned by a user to lock the damper arrangement to maintain the screen door in the open position. However, in the case where the user is trying to enter the premises with package(s), the user must then place the package(s) down on the ground, open the screen door, move the metal tab to a locking position, pick up the packages, operate the entry lock, open the entry door, place the package(s) down, and then go back and move the metal tab back to its deactivated position which will permit the screen door to move to the closed position. This is definitely an inconvenient procedure when trying to locate the screen door in the open position while access through the entry door is occurring.

SUMMARY OF THE INVENTION

The primary objective of the present invention is to construct a mechanism which will automatically hold the screen door in its open position until the user has had adequate time to open an entry door and enter the premises of a house or building. Upon entry being achieved, the screen door will automatically then move from the open position to the closed position.

The structure of the present invention utilizes a bracket which is to be mounted on the door jamb between the entry door and the screen door. A spring/damper arrangement, which moves the screen door slowly from its open position to the closed position, is mounted in conjunction with the bracket. The bracket includes a catch mechanism that holds the screen door in the open position. A spring biased follower is located against the entry door and upon movement of the entry door from its closed position to its open position, the follower will disengage the catch mechanism permitting the screen door to move from its open position to the closed position.

BRIEF DESCRIPTION OF THE DRAWINGS

FIG. 3 is a top plan view similar to FIG. 1 but showing the screen door in its open position with the screen door being held in the open position by the catch mechanism of the delay door closer of the present invention;

FIG. 4 1is a view similar to FIG. 2 but taken along line 4—4 of FIG. 3;

DETAILED DESCRIPTION OF THE PREFERRED EMBODIMENT

Figure 1:
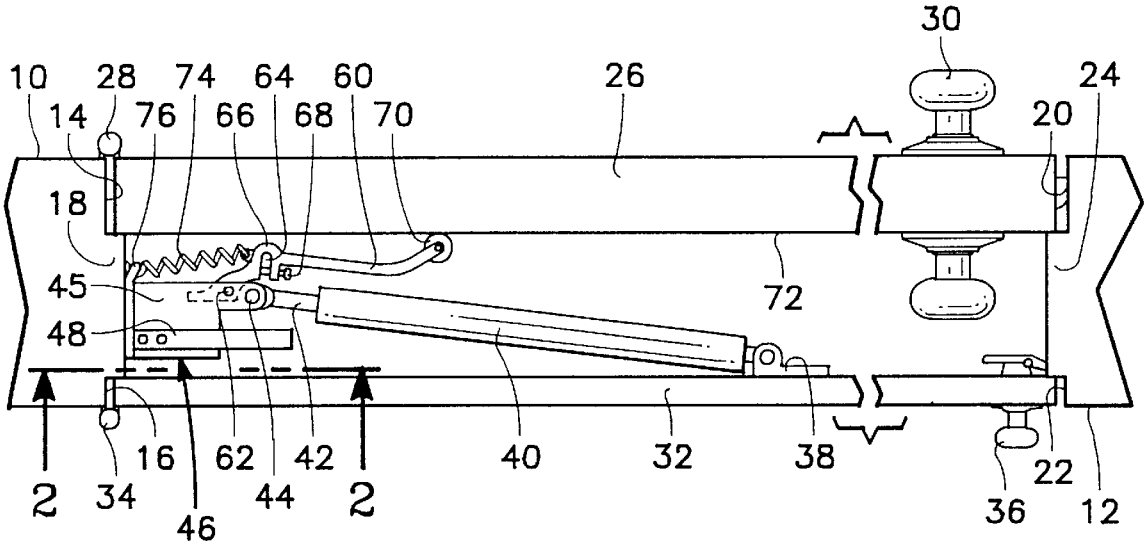
FIG. 1 is a top plan view of an entry door and its associated screen door showing the delay door closer of the present invention in its deactivated position with both the entry door and the screen door being closed.

Referring particularly to the drawings, there is shown a conventional door jamb which has a left side rail 10 and a right side rail 12. It is to be understood that there is a top rail connecting the left side rail 10 and the right side rail 12 which is not shown. The left side rail 10 includes an inner relieved area 14 and an outer relieved area 16 with an elongated protrusion 18 separating the inner relieved area 14 and the outer relieved area 16. In a similar manner the right side rail 12 includes an inner relieved area 20 and an outer relieved area 22 with an elongated protrusion 24 being located therebetween. An entry door 26 is mounted between the inner relieved areas 14 and 20 with a hinge 28 mounting the entry door 26 on the left side rail 10. The entry door 26 includes a door knob and lock assembly 30 which is to operate in conjunction with the right side rail 12.

A screen door 32 is to be mounted between the outer relieved areas 16 and 22 with the screen door being mounted to the left side rail 10 by means of hinge 34. The screen door 32 also includes a door knob and lock mechanism 36 which is to operate in conjunction with the right side rail 12. Fixedly mounted on the inside surface of the screen door 32 is a bracket 38. The bracket 38 pivotally mounts the outer end of a pneumatic cylinder 40. The pneumatic cylinder 40 functions to damp the closing movement of the screen door 32 and to also provide a biasing force tending to locate the screen door 32 in the closed position. This is deemed to be conventional as previously mentioned within the Description of the Prior Art. Extending from the pneumatic cylinder 40 is a linearly movable shaft 42. The outer end of the linearly movable shaft is pivotally mounted by means of pin 44 to a bracket 46. Bracket 46 has an upper member 45 and a lower member 47. Upper member 45 is located parallel to lower member 47 and spaced about one-quarter inch apart forming a gap area 49 therebetween. The bracket 46 is fixedly mounted onto the elongated protrusion 18. It should be noted that although only a left-hinged door is shown, the present invention works equally as well on right-hinged doors.

Figure 2:
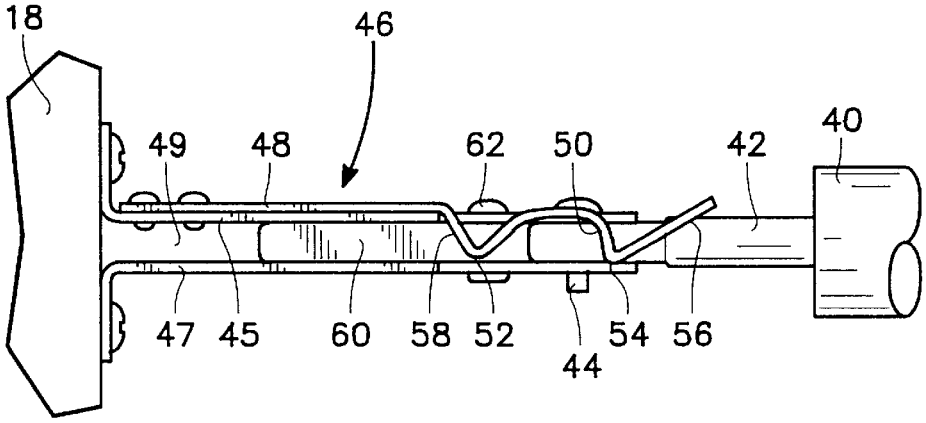
FIG. 2 is a front view, partially in cross-section, of the delay door closer of the present invention taken along line 2—2 of FIG. 1.
Figures 3, 4:
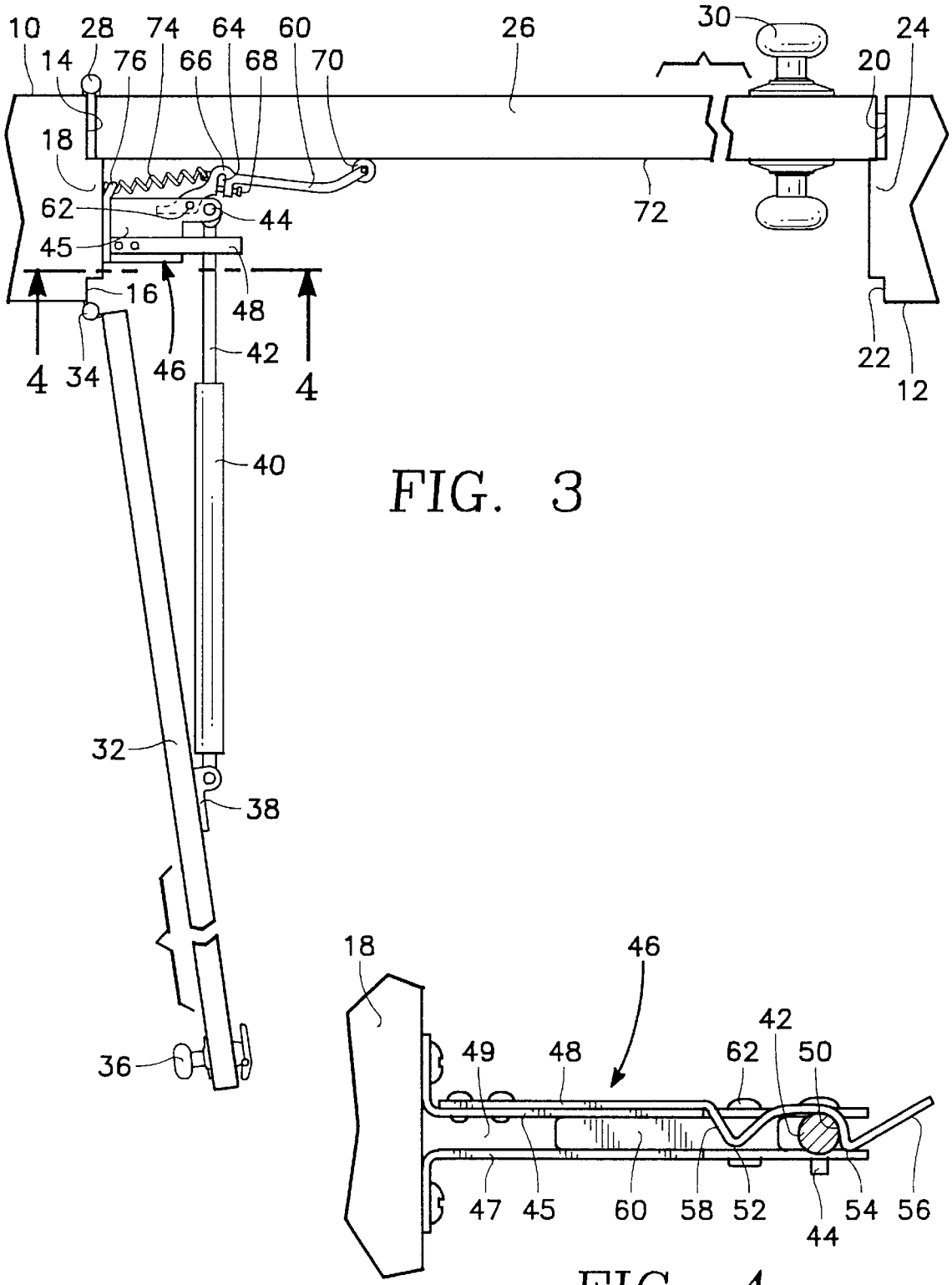

Mounted also on the upper member 45 is a catch mechanism in the form of cantilever spring 48. The at-rest position of cantilever spring 48 is shown in FIG. 2. This at-rest position could also be the locking position which is shown in FIG. 4. Cantilever spring 48 includes a recessed area 50 which is formed on the inner side by a raised protrusion 52 and on the outer side by a raised protrusion 54. Connecting with the raised protrusion 54 is a cam surface 56 and in a similar manner connecting with the raised protrusion 52 is a cam surface 58.

Located in the gap area 49 is a follower arm 60. The follower arm 60 is pivotally mounted by means of pin 62 to both upper member 45 and lower member 47. Follower arm 60 includes a relief 64 which forms a thin hinge section 66. Mounted within the follower arm 60 is a thumb screw 68 which extends across the relief 64. The outer end of the follower arm includes a wheel 70. A tension spring 74 connects between the follower arm 60 and a tab 76 which is integral with the bracket 46. The biasing of the tension spring 74 is such as to hold the wheel 70 of follower 60 against the outer surface 72 of the entry door 26.

Figure 5:
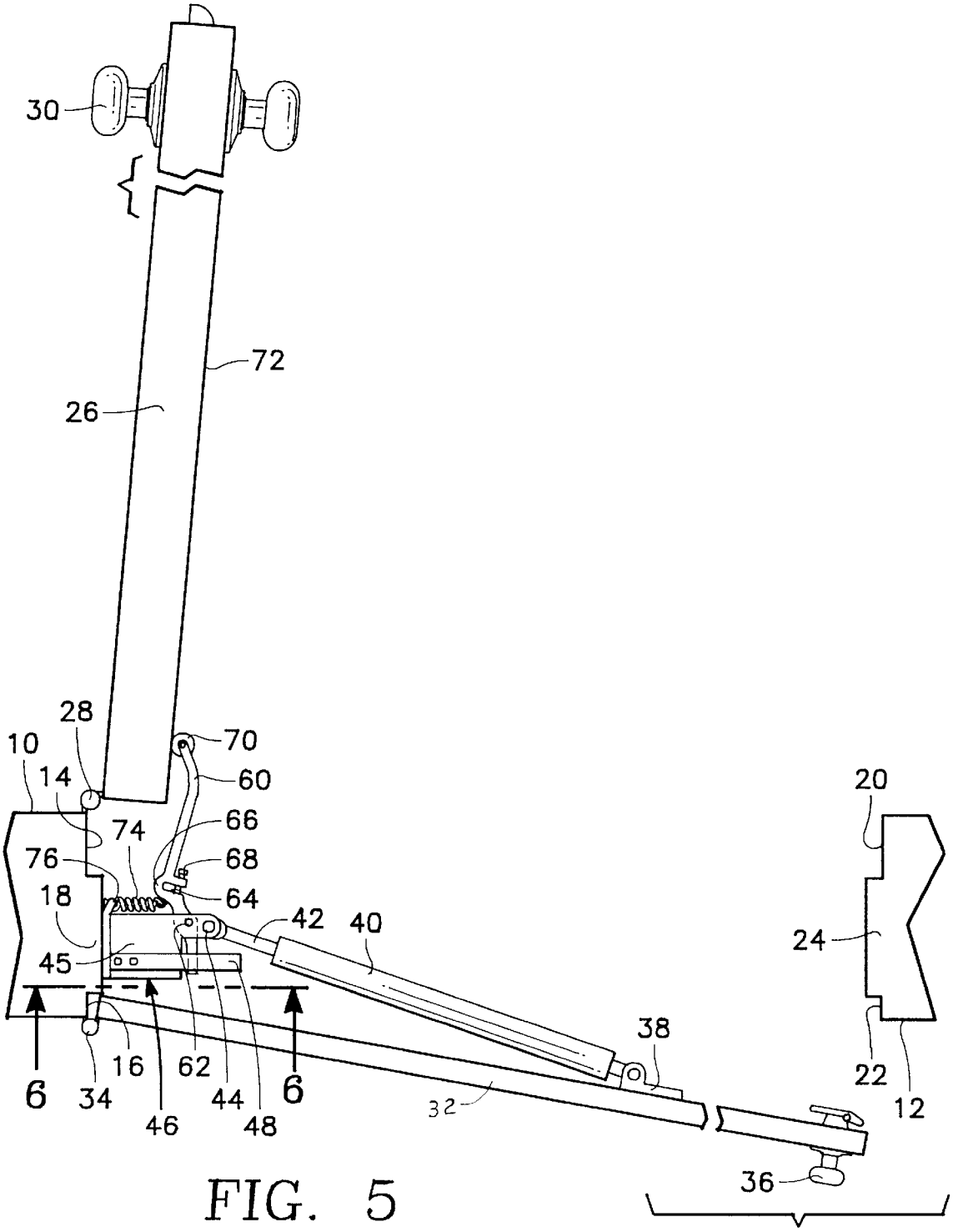
FIG. 5 is a top plan view similar to FIG. 3 with the exception that the entry door is now in the open position and the screen door is in the process of moving to the closed position.
Figure 6:
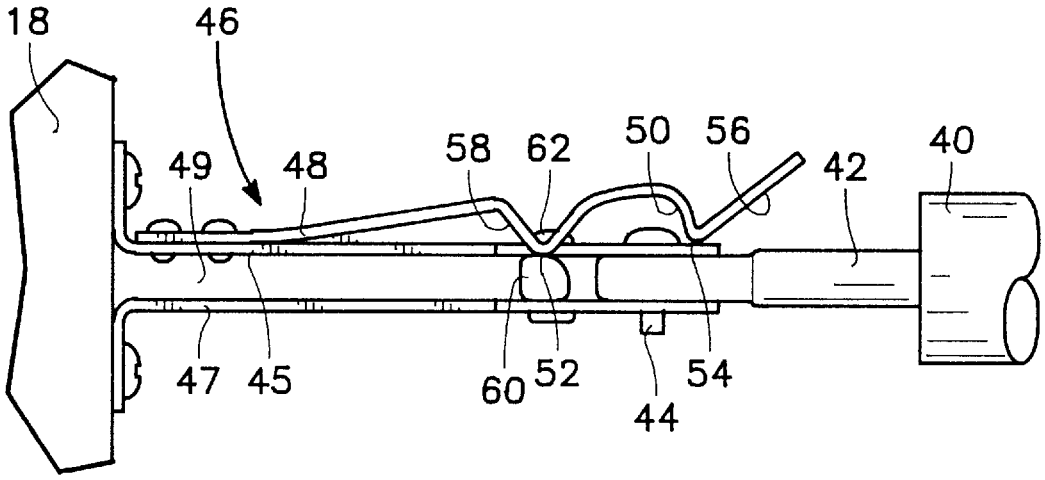
FIG. 6 is a view similar to FIG. 4 taken along line 6—6 of FIG. 5.

The operation of the delay door closer of this invention is as follows: Let it be assumed that the user is entering the house or building from the outside so the user will first grab the door knob and lock assembly 36 and open the screen door 32 to the open position shown in FIG. 3. The shaft 42 engages with the cam surface 56 pivoting in an upward direction cantilever spring 48 until the shaft 42 will override the raised area 54 and come to rest within the recess 50. At this particular time the screen door 32 is in the totally open position as shown in FIG. 3 and is held in that position by means of cantilever spring 48. The user can then operate the door knob and lock assembly 30 and open the entry door 26 from the closed position shown in FIGS. 1 and 3 to the open position shown in FIG. 5. When the entry door 26 is opened a prescribed amount, such as eighty-five degrees, the end of the follower arm 60 opposite to the wheel 70 will be moved against the cam surface 58 with the result that the raised area 52 will ride up and on the follower arm 60. This will cause the shaft 42 to become disengaged from the recess 50 and the screen door 32 will then be permitted to move from the open position shown in FIG. 3 to the closed position shown in FIG. 1 with the intermediate position of this movement being shown in FIG. 5. It is to be understood that the screen door 32 will be under a continuous bias by some form of biasing device tending to move the screen door to the closed position. A typical biasing device is a coil spring (not shown) that is included with the pneumatic cylinder 40. By the time the closing movement of the screen door 32 is initiated the user should be inside the building. The user can then close the entry door 72 in the normal manner or leave it open. If it is left open the catch function of the cantilever spring 48 will stay deactivated and the screen door 32 will operate like an ordinary screen door.

If it is desired to have both the entry door 26 and the screen door 32 open at the same time, such as when carrying a number of items through the door opening, entry door 26 may be opened to a point just before it releases the screen door 26. If the screen door 26 is being held open by the cantilever spring 48, it may be released manually at any time by pulling the screen door 26 closed a few degrees. This forces the shaft 42 past protrusion 54 at the cantilever spring 48, thus releasing the screen door 32.

The point at which the entry door 26 released the screen door 32 may be adjusted, within limits, by the user by means of the thumbscrew 68. Screwing in the thumbscrew 68 causes the follower 60 to flex at hinge section 66 resulting in the screen door 32 being held until the entry door 26 is opened farther in comparison to before the adjustment. Conversely, screwing out the thumbscrew 68 causes the screen door 32 to be released sooner.

When exiting the building the entry door 26 is first opened. If the screen door 32 is not opened far enough to be held by cantilever spring 48, then it will operate like an ordinary screen door. If it is desired that the screen door 32 be held open, as when carrying packages or locking a deadbolt, then it is opened until the catch is engaged. The screen door 32 is then closed by pulling it closed a few degrees, then letting it close under its own power as previously described.

What is claimed is:

1. A delayed door closer adapted for usage in conjunction with a dual door arrangement composed of a first door mounted in juxtaposition with a second door, said delayed door closer comprising:

first means for holding the first door in an open position against a biasing force tending to move said first door toward a closed position; and second means for automatically causing the first door to be moved by said biasing force to a closed position upon opening of the second door, said second means to connect with said first means and cause disengagement of said first means upon opening of the second door.

2. In combination with a door arrangement where a first door is mounted in juxtaposition to a second door, said first door being movable between a first open position and a first closed position, said first door having a biasing device exerting a biasing force against said first door tending to move said first door from said first open position to said first closed position and to maintain said first door in said first closed position, said second door being movable between a second open position and a second closed position, a delayed door closer comprising:

a catch mechanism mounted on said first door, said catch mechanism to lock and hold said first door in said first open position; and a catch release mechanism connected to said second door, said catch release mechanism causing disengagement of said catch mechanism upon said second door being moved from said second closed position to said second open position resulting in said first door moving by said biasing device from said first open position to said first closed position.

3. The combination as defined in claim 2 wherein:

said catch mechanism including a pneumatic cylinder functioning to damp the movement of said first door when moving from said first open position to said first closed position, a piston shaft connected to said pneumatic cylinder, said piston shaft engaging with said catch mechanism to hold said first door in said first open position.

4. The combination as defined in claim 2 wherein:

the location of said second open position being adjustable, whereby the extent of movement of said second door to said second open position being variable according to individual desires.

5. The combination as defined in claim 2 wherein:

said catch release mechanism being continuously spring biased in the direction of said second door to said second open position.

6. In combination with a door frame, said door frame having mounted therein a door arrangement composed of a first door and a second door, said first door being mounted in juxtaposition to said second door, said first door being movable between a first open position and a first closed position, said first door having a biasing device exerting a biasing force against said first door tending to move said first door from said first open position to said first closed position and to maintain said first door in said first closed position, said second door being movable between a second open position and a second closed position, a delay door closer comprising:

a bracket rigidly mounted to said door frame;

a catch mechanism which when activated holds said first door in said first open position; and a catch release mechanism connected to said bracket, said catch release mechanism deactivates said catch mechanism upon said second door being located in said second open position which permits said first door to move by the biasing device from said first open position to said first closed position.

7. The combination as defined in claim 6 wherein:

said catch release mechanism including a follower, said follower being in contact with said second door, said follower pivoting relative to said bracket when said second door moves from said second closed position to said second open position and vice versa when said second door reaches said second open position said follower causes disengagement of said catch mechanism.

8. The combination as defined in claim 7 wherein:

said follower being continuously spring biased to a position with said second door in said second open position.

9. The combination as defined in claim 7 wherein:

said catch mechanism including a pneumatic cylinder which functions to damp the movement of said first door when moving from said first open position to said first closed position, a piston shaft connected with said pneumatic cylinder, said piston shaft engaging with said catch mechanism to hold said first door in said first open position.

10. The combination as defined in claim 7 wherein:

the location of said second open position being adjustable according to individual desires.

* * * * *